US008944716B2

(12) United States Patent
Sawa et al.

(10) Patent No.: US 8,944,716 B2
(45) Date of Patent: Feb. 3, 2015

(54) VALVED APPLICATOR

(75) Inventors: Yukinori Sawa, Fujioka (JP); Tooru Nakajima, Fujioka (JP)

(73) Assignee: Mitsubishi Pencil Company, Limited, Shinagawa-Ku, Tokyo (JP)

( * ) Notice: Subject to any disclaimer, the term of this patent is extended or adjusted under 35 U.S.C. 154(b) by 388 days.

(21) Appl. No.: 13/390,640

(22) PCT Filed: Sep. 1, 2010

(86) PCT No.: PCT/JP2010/064940

§ 371 (c)(1),
(2), (4) Date: Feb. 15, 2012

(87) PCT Pub. No.: WO2011/027788

PCT Pub. Date: Mar. 10, 2011

(65) Prior Publication Data

US 2012/0141189 A1 Jun. 7, 2012

(30) Foreign Application Priority Data

Sep. 1, 2009 (JP) ..... 2009-201766
Aug. 30, 2010 (JP) ..... 2010-192409

(51) Int. Cl.

*B43K 5/00* (2006.01)
*B43K 8/00* (2006.01)
*B43K 8/02* (2006.01)
*B43K 8/04* (2006.01)

(Continued)

(52) U.S. Cl.

CPC . *B43K 8/003* (2013.01); *B43K 8/02* (2013.01); *B43K 8/04* (2013.01); *B43K 23/12* (2013.01); *B43K 23/126* (2013.01); *B43K 25/022* (2013.01)

USPC ..... 401/202; 401/262; 401/243

(58) Field of Classification Search

USPC ..... 401/202, 262, 98, 213, 243–247, 269
See application file for complete search history.

(56) References Cited

U.S. PATENT DOCUMENTS 1,379,057 A * 5/1921 Spelling ..... 401/125
2,947,015 A * 8/1960 Burt ..... 401/183

(Continued)

FOREIGN PATENT DOCUMENTS

CN 2487559 4/2002
CN 1780741 5/2006

(Continued)

OTHER PUBLICATIONS

International Search Report (PCT/ISA/210) issued on Sep. 28, 2010, by Japanese Patent Office as the International Searching Authority for International Application No. PCT/JP2010/064940.

(Continued)

*Primary Examiner* — David Walczak
*Assistant Examiner* — Jennifer C Chiang
(74) *Attorney, Agent, or Firm* — Buchanan, Ingersoll & Rooney PC

(57) ABSTRACT

An applicator cap is closed on the front side and opening on the rear side, covering an applying part provided in the front end of a barrel cylinder of an applicator, from the rear-side opening, and detachably fitted on the barrel cylinder so as to be able to seal and keep the surrounding space of the applying part airtight, and includes a holding portion formed such that the middle part of the cap with respect to the axial direction is smaller in outside diameter than the front end with respect to the axial direction.

5 Claims, 20 Drawing Sheets

(51) Int. Cl.

| | |
|---|---|
| ***B43K 23/12*** | (2006.01) |
| ***B43K 25/02*** | (2006.01) |

(56) References Cited

U.S. PATENT DOCUMENTS

| | | | | |
|---|---|---|---|---|
| 3,106,742 | A * | 10/1963 | Schultz et al. | 401/202 |
| 4,844,250 | A * | 7/1989 | Holoubek et al. | 222/107 |
| 5,219,448 | A * | 6/1993 | Hackmann | 401/176 |
| 6,247,865 | B1 | 6/2001 | Russell et al. | |
| 2004/0028464 | A1 | 2/2004 | Nishitani et al. | |
| 2004/0213627 | A1 | 10/2004 | Marschand et al. | |
| 2005/0008421 | A1 | 1/2005 | Oike | |

FOREIGN PATENT DOCUMENTS

| | | | |
|---|---|---|---|
| JP | 1-107472 | U | 7/1989 |
| JP | 3-22571 | U | 3/1991 |
| JP | 6-59091 | U | 8/1994 |
| JP | 11-138085 | A | 5/1999 |
| JP | 2002-355602 | A | 12/2002 |
| JP | 2004-017566 | A | 1/2004 |
| JP | 2004-174956 | A | 6/2004 |

OTHER PUBLICATIONS

Notification of Transmittal of Translation of the International Preliminary Report on Patentability(Chapter I and II) (Form PCT/IB/373 & Form PCT/IB/338) and the Written Opinion of the International Searching Authority (Form PCT/ISA/237) issued on Mar. 29, 2012, in the corresponding International Application No. PCT/JP2010/064940. (6 pages).

The Extended Search Report issued on Oct. 17, 2013, by the European Patent Office in corresponding European Patent Application No. 10813737.3-1704. (3 pages).

Search Report Result of Chinese Office Action dated Mar. 5, 2014, issued by the Chinese Patent Office in corresponding Chinese Patent Application No. 2010800389715. (1 page).

* cited by examiner 16
30
20

32
32a
22
22a
20
30
16

32
32a
22
22a
20
30
16

32
32a
22
14
22a
20
30
16

32
22
14
16

24b
24

24b
24
24c
24a 24b
24
24c
24a 24b
24
24c
24a
24e 24b
24f
24g
24h
24
24c
24d
24a
24e 24
24c
24a 24b
24

24b
24g
24
24c
24h
24a 24b
24c
24a
24

24b
24c
24a
24

24c
24a
24

24b
24c
24a
24

24b
24c
24a
24

24c
24a
24

20
22

32a
32b
32
34
22a
22
20b
20c
20a
20

32a
32
22a
22
20

32a
32
22a
22
20

32a
32
32b
34
22
20

32
32a
32b 30
16

14X
32
32a
22(22a)
20
30
16

14X
32
32a
22
22a
20
30
16

14X
32
32a
14b
32b
22
34
22a
20
30
16

32
32a
14b
14X 30
16

14Z
32a
32
22(22a)
20
30
16

14Z
32a
32
22(22a)
20
30
16

14Z
32a
32
22
22a
20
30
16

32
32a
14Z

14

14

14

14

14

VALVED APPLICATOR

TECHNICAL FIELD

The present invention relates to a valved applicator which opens the valve opposing the elastic force of a spring part by pressing an applying part as a writing tip to thereby feed ink to the applying part.

BACKGROUND ART

Marker pens that markdown on a metal material or resin material with an oil-based ink or the like, are frequently used when marking products in a factory, and in most cases those pens are stored with their writing point downward.

However, when the conventional product is kept with its writing point down, the valve interior cannot be agitated so that the concealing material or pigment in the ink precipitates, whereby the interior of the valve is clogged, and the value will not provide correct functions, possibly causing writing failure.

Concerning ink agitation, there has been a disclosure of a valved applicator that accommodates a spherical or rod-like agitator inside the application liquid chamber (Japanese Utility Model H01-107472: Patent Document 1).

However, the valved applicator of this patent document 1, the agitator will not go into the interior of the valve at the time of agitation, so that the valve interior cannot be well agitated.

PRIOR ART DOCUMENT

Patent Document

Patent Document 1: Japanese Utility Model 01-107472

SUMMARY OF THE INVENTION

Problems to be Solved by the Invention

In view of the above circumstances, the present invention is to provide a valved applicator in which an agitator can go into the valve interior at time of agitation.

Means for Solving the Problems

The present invention relates to a valved applicator.

The present invention is a valved applicator in which an ink tank for storing ink in the rear part of a barrel cylinder is communicated with the interior of the front part of the barrel cylinder and an agitator is arranged inside the ink tank while an applying part with its front end projected out, a valve element that opens and closes an ink flow path and a spring part that urges the valve element forwards by elastic force are arranged in the front part of the barrel cylinder, and when the applying part at the writing point is pressed, the valve element is opened opposing the elastic force of the spring part to thereby feed ink to the applying part, characterized in that a space which the agitator can be inserted into and pulled out of is provided inside the spring part.

In the present invention, it is preferable that the agitator is given in a rod-like form having a large diametric portion greater in diameter than the other part while a constraint receiver that engages the large-diametric portion of the agitator so as to restrain the front end of the agitator from abutting the interior of the front end of the spring part is provided in the barrel cylinder.

In the present invention, it is preferable that the spring part is formed of resin, having the valve element integrated in the front end thereof.

Further, in the present invention, it is preferred that the spring part is formed of resin, having an integrally formed constraint receiver as an abutment smaller in inside diameter than the outside diameter of the large-diametric portion of the agitator, in the rear end thereof.

Further, in the present invention, it is preferred that the agitator is formed of resin and has a symmetrical shape with respect to the front-to-rear direction.

Effect of the Invention

According to the valved applicator of the present invention, the agitator is given in a rod-like form having a rear end part that is enlarged in diameter than the other part while a space which the agitator can be inserted into and pulled out of is provided inside the spring part. As a result, the agitator goes into the interior of the spring part when the applicator is shaken to agitate by the agitator, so that there is no risk of writing failure, which would occur due to malfunction of the valve as a result of valve clogging when concealing material or pigment in the ink has precipitated.

In the present invention, when the agitator is given in a rod-like form having a large diametric portion greater in diameter than the other part while a constraint receiver that engages the large-diametric portion of the agitator so as to restrain the front end of the agitator from abutting the interior of the front end of the spring part is provided in the barrel cylinder, the agitator will not directly collide with the valve element, so that there is no risk of the valve opening during agitation and hence there is no risk of ink leaking or flooding.

In the present invention, when the spring part is formed of resin, with the valve element integrated in the front end thereof, it is possible to reduce the number of parts and simplify molding and handling.

Further, when the spring part is formed of resin, with an integrally formed constraint receiver as an abutment smaller in inside diameter than the outside diameter of the large-diametric portion of the agitator, in the rear end thereof, there is no need to perform separate attachment so that molding and handling can be further simplified.

Further, since the agitator is made of resin and can be formed by injection molding, this produces excellent effect such as producing good productivity.

Further, since the symmetric configuration of the agitator with respect to the front-to-rear direction makes it unnecessary to care about the direction of insertion into the barrel cylinder, this produces excellent effect on assembly performance.

MODE FOR CARRYING OUT THE INVENTION

The embodiments of the present invention will be described hereinbelow with reference to the accompanying drawings.

FIGS. 1 to 20 are illustrative diagrams showing applicators (e.g., writing instruments) provided with a cap and their component structures according to the embodiments.

Figure 1:
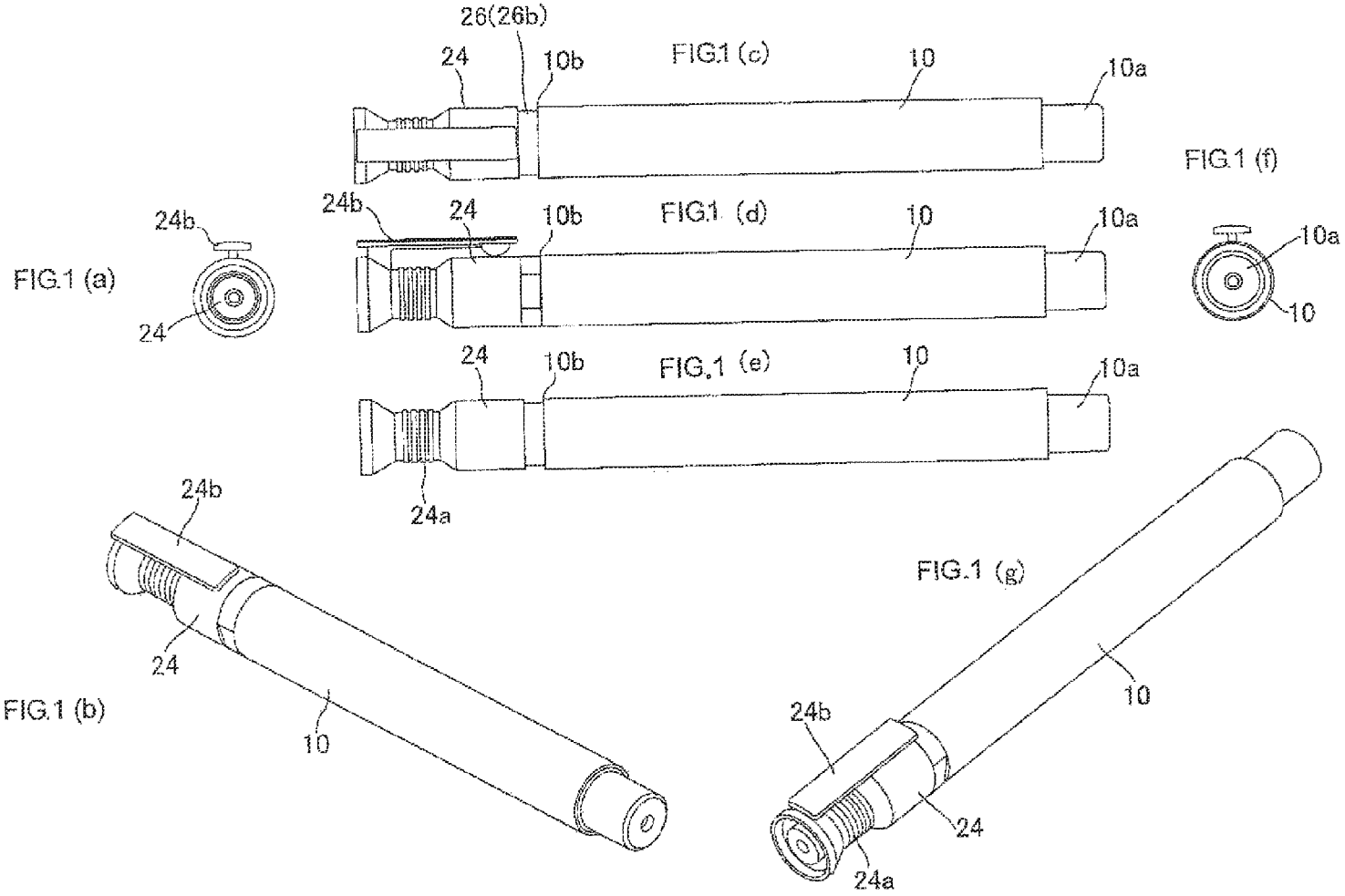
FIG. 1 is an overall illustrative diagram of a valved applicator according to the first embodiment of the present invention, (a) being a view from the side of a cap located at the front end in the axial direction, (b) a rear-side perspective view, (c) a first side view, (d) a second side view that is rotated 90° from the first side view, (e) a third side view that is further rotated 90° from the second side view, (f) a view from the rear end in the axial direction and (g) a front perspective view.

FIGS. 1(*a*) to (*g*) are overall illustrative diagrams of an applicator according to an embodiment.

Figure 2:
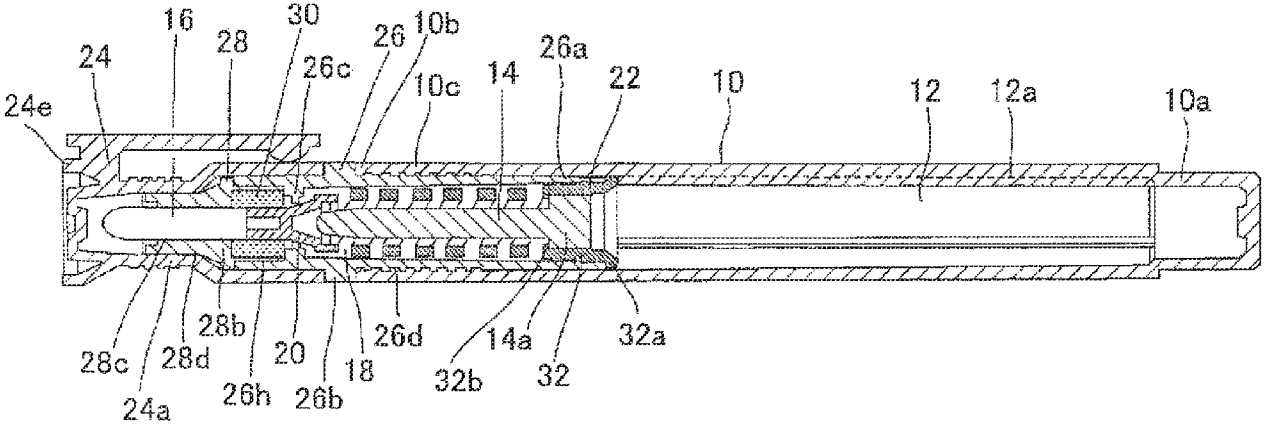
FIG. 2 (*a*) is a vertical sectional diagram of FIG. 1, (*b*) a view from the cap side at the front end in the axial direction.
Figure 2:
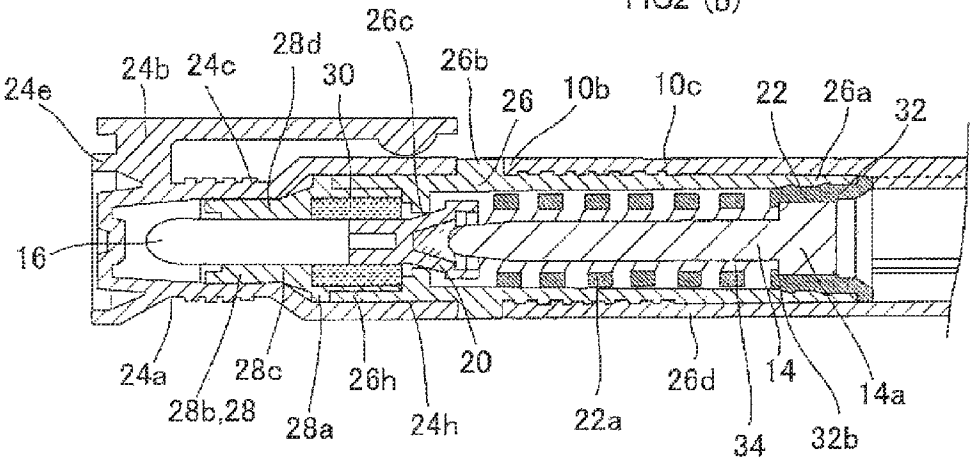
Figure 3:
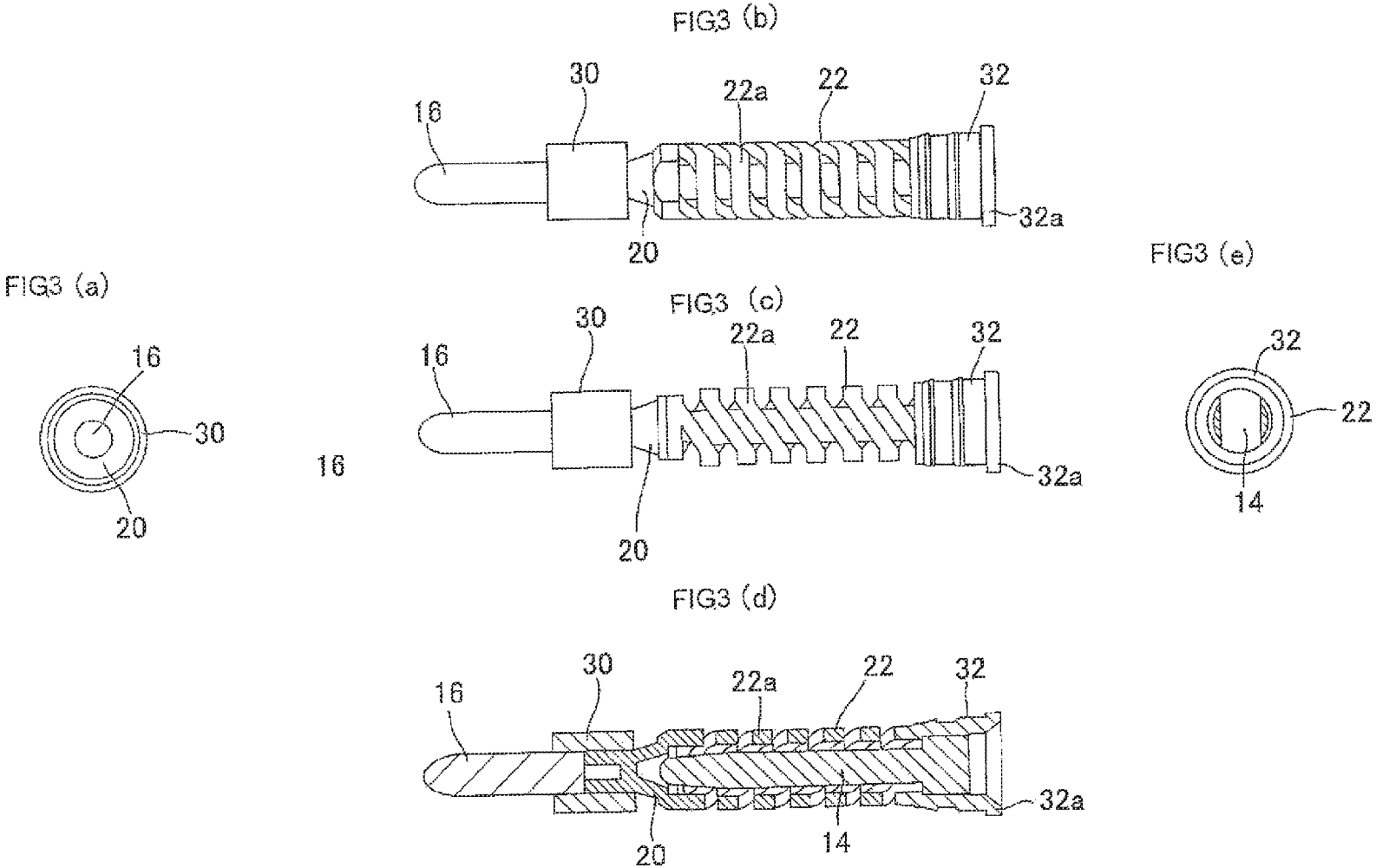
FIG. 3 is an illustrative diagram of a configuration in which a spring part with a valve element integrally formed at the front end thereof is assembled with an applying part and a sponge part and is attached with an agitator, (a) being a view from the front in the axial direction, (b) a first side view, (c) a second side view, (d) a vertical sectional view and (e) a view from the rear in the axial direction.
Figure 4:
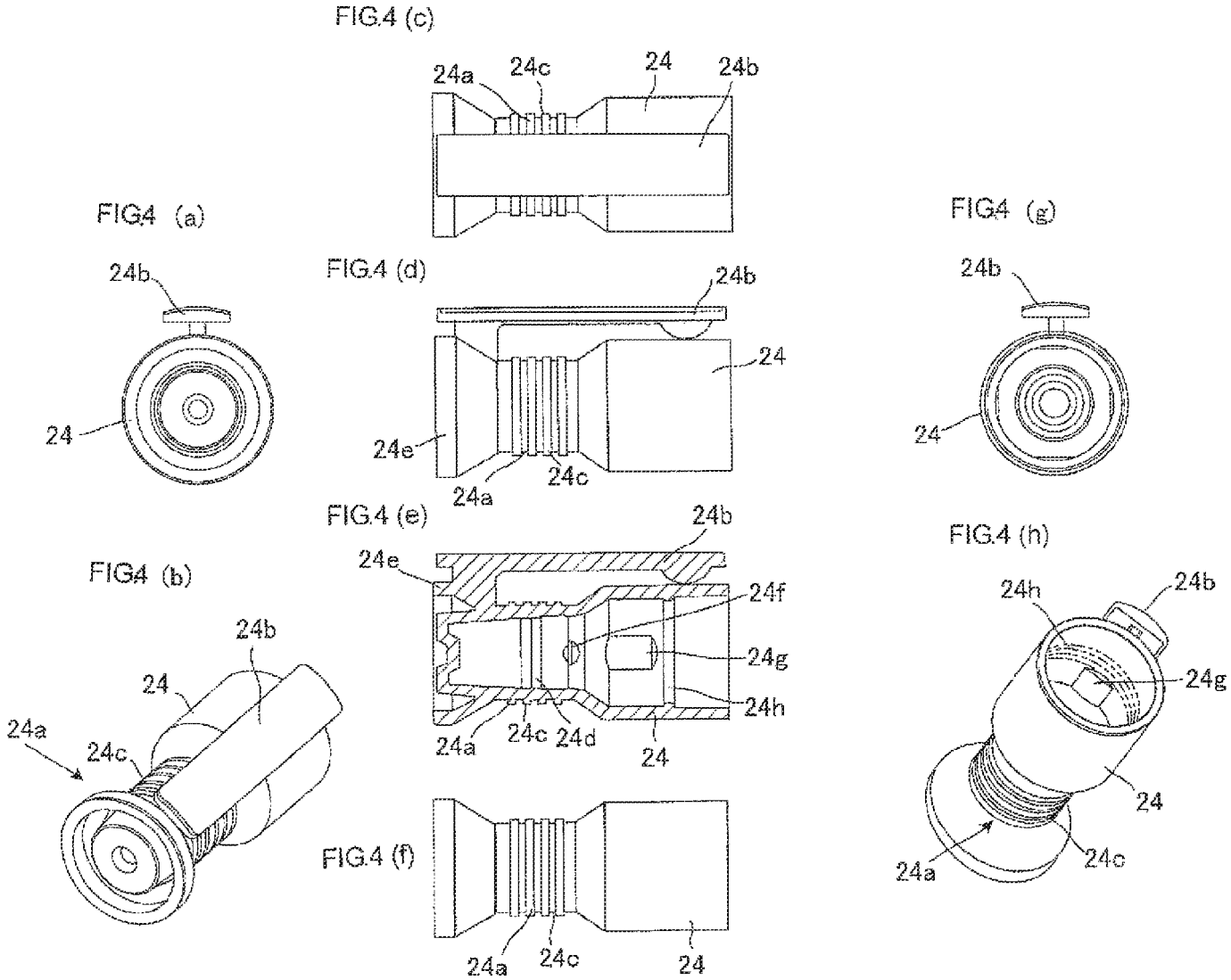
FIG. 4 is an illustrative diagram of a cap, (a) being a view from the front in the axial direction, (b) a front-side perspective view, (c) a first side view, (d) a second side view that is rotated 90° from the first side view, (e) a vertical sectional view, (f) a third side view that is further rotated 90° from the second side view, (g) a view from the rear in the axial direction and (h) a rear-side perspective view.
Figure 5:
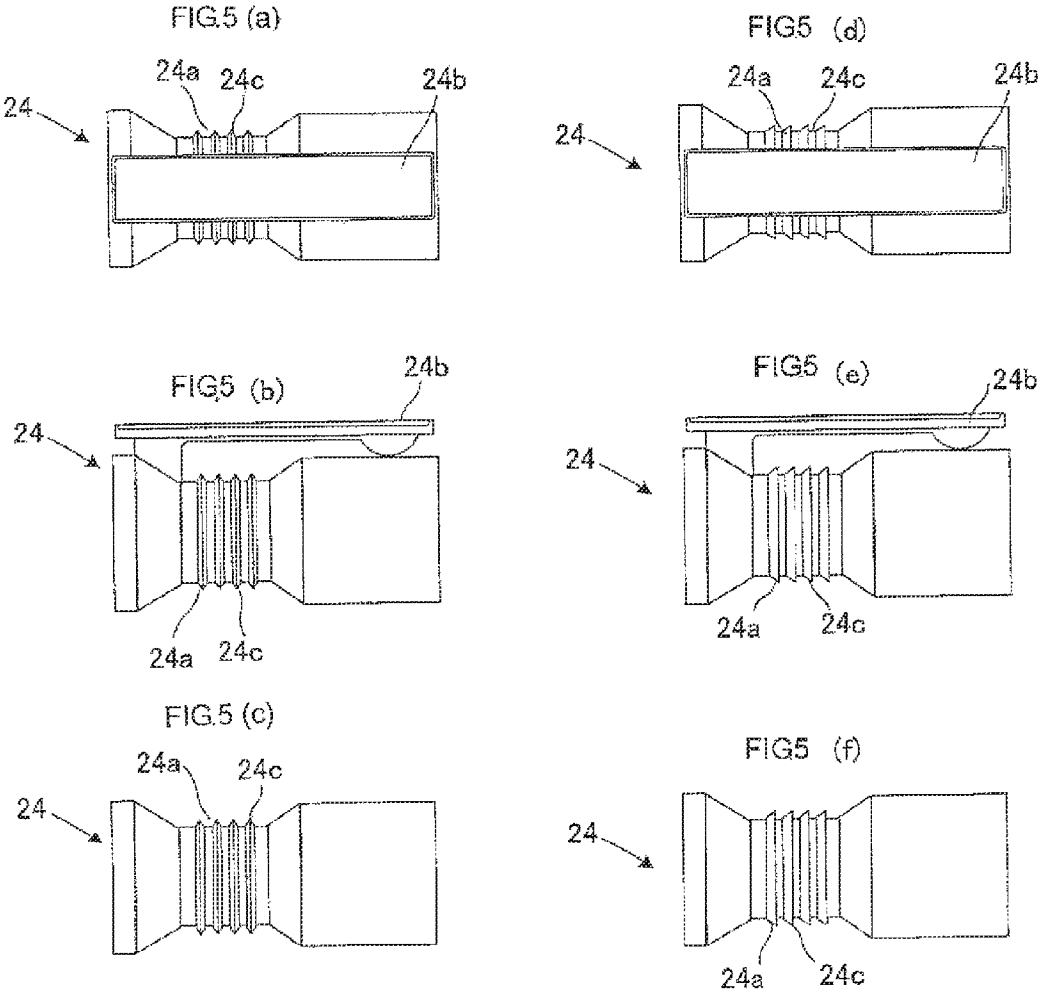
FIG. 5 is an illustrative diagram of examples 1 and 2 showing various types of cap slip-stoppers, (a) being a first side view of a cap according to example 1, (b) a second side view that is rotated on the axis 90° from the first side view, (c) a third side view that is further rotated on the axis 90° from the second side view, (d) a first side view of a cap according to example 2, (e) a second side view that is rotated 90° from the first side view and (f) a third side view that is further rotated on the axis 90° from the second side view.

FIGS. 2(*a*) and (*b*) are illustrative diagrams of the configuration of an applicator according to the first embodiment; FIGS. 3(*a*) to (*e*) are illustrative diagram of a configuration of the applicator in which a spring part integrally formed with a valve element is assembled with a sponge and attached with an agitator. FIGS. 4(*a*) to (*h*) are structural illustrative diagrams of a cap of the applicator; FIGS. 5(*a*) to (*f*) are illustrative diagrams of examples 1 and 2 of caps; and FIGS. 6(*a*) to (*f*) are illustrative diagrams of the spring part integrally formed with a valve element.

Figure 7:
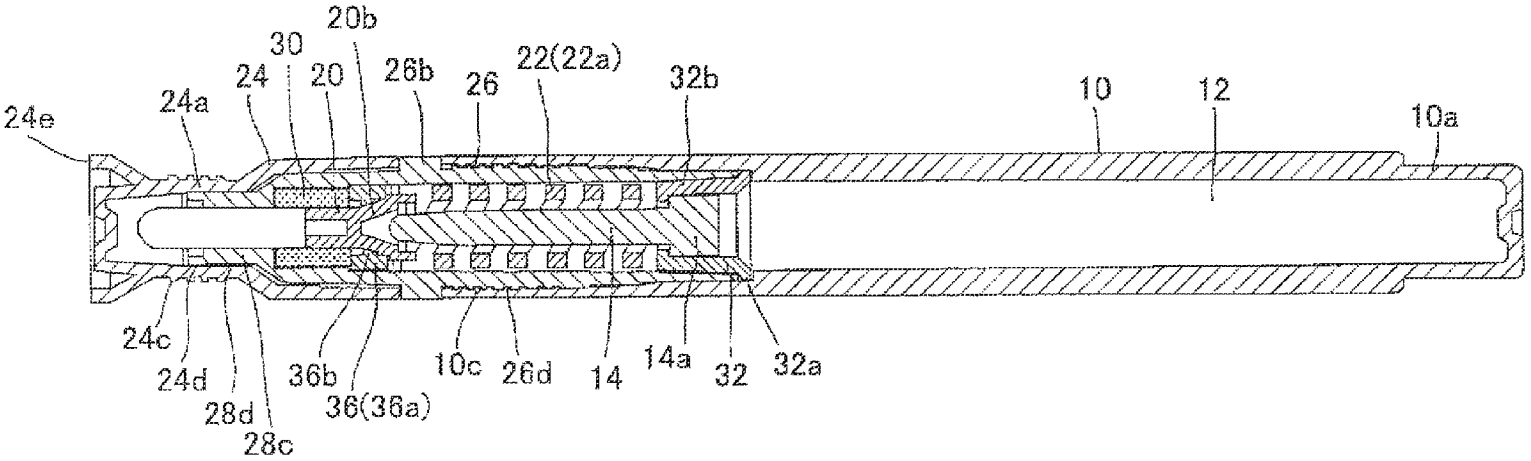
FIG. 7 is an illustrative diagram in vertical section of an applicator of the second embodiment.

FIG. 7 is an overall illustrative diagram in vertical section of an applicator of the second embodiment.

Figure 10:
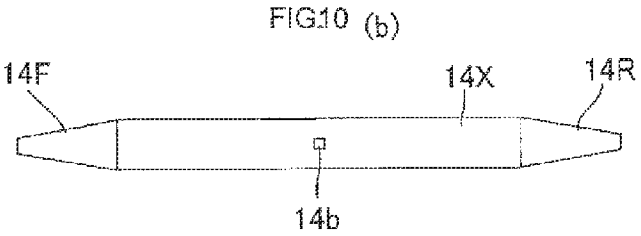
FIG. 10 is an illustrative diagram of an agitator arranged inside the applicator of FIG. 8, (a) being a view from the front in the axial direction, (b) a first side view, (c) a second side view, (d) a vertical sectional view and (e) a view from the rear in the axial direction.
Figure 10:
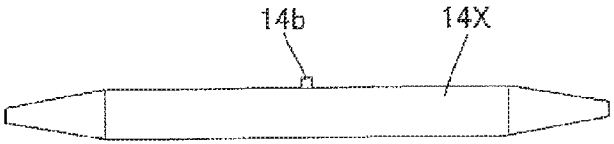
Figure 10:
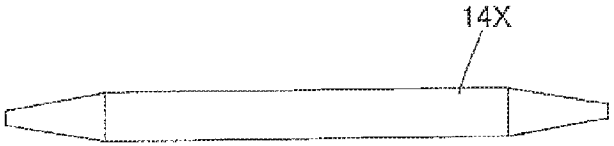
Figure 10:
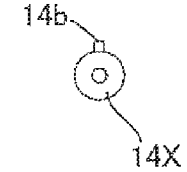
Figure 10:
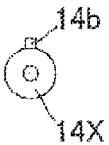
Figure 11:
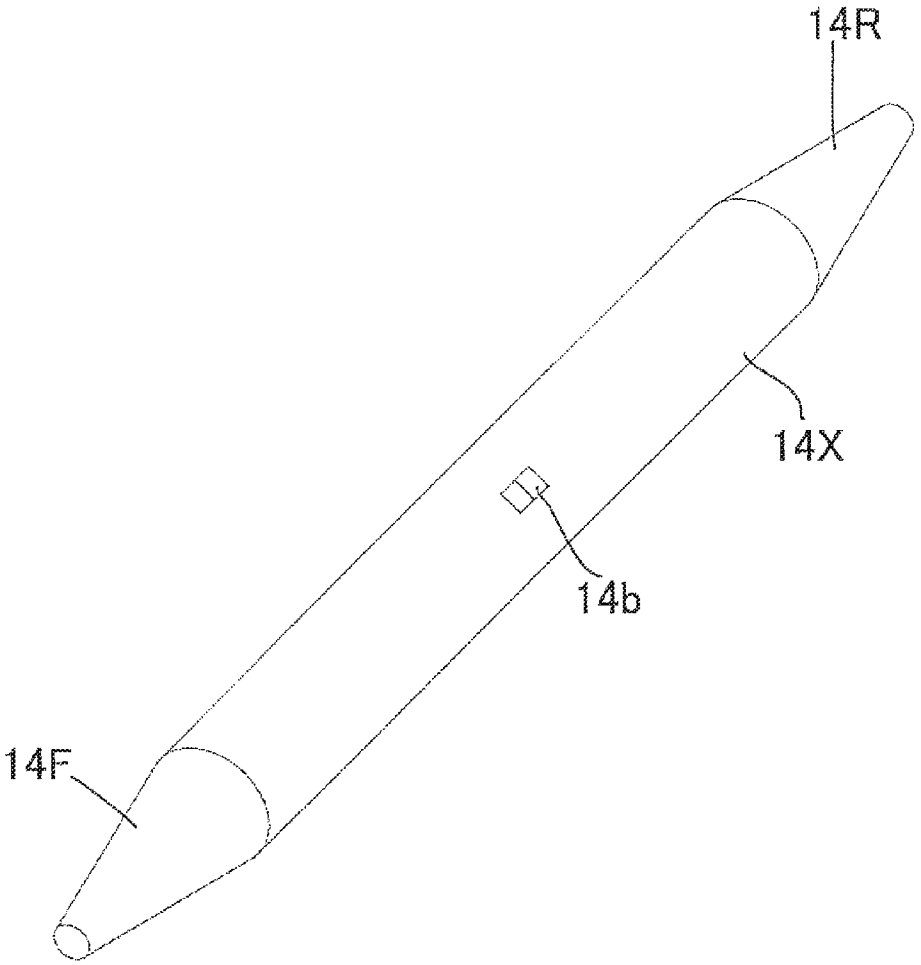
FIG. 11 is a perspective view of an agitator arranged inside the applicator of FIG. 8.
Figure 12:
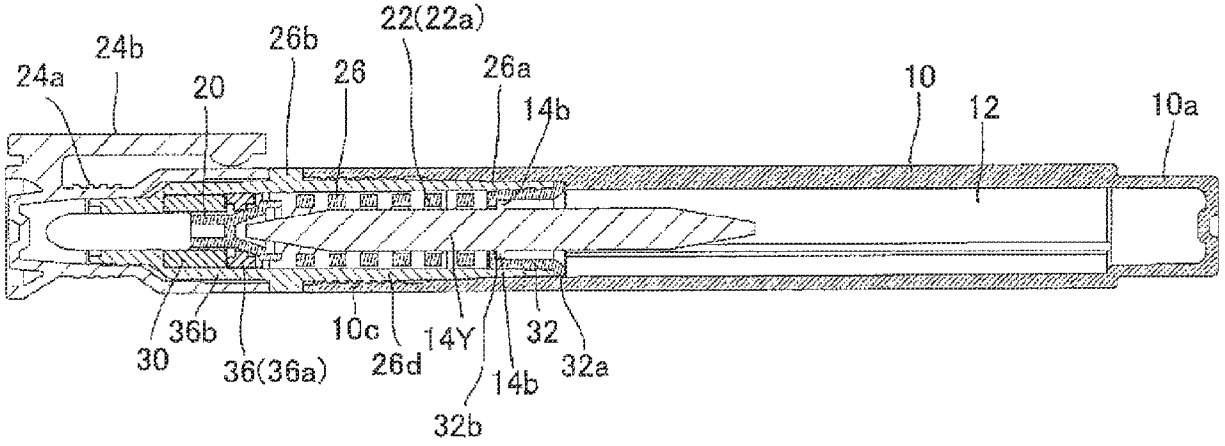
FIG. 12 is an illustrative diagram of an applicator of the fourth embodiment, (a) being a view from the front in the axial direction and (b) a vertical sectional view.
Figure 12:
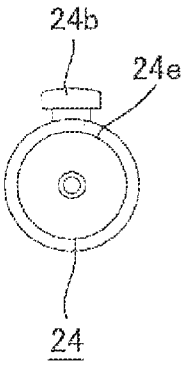
Figure 13:
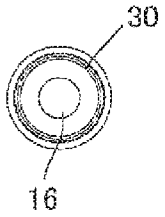
FIG. 13 is an illustrative diagram of a configuration in which a spring part with a valve element integrally formed at the front end thereof is assembled with an applying part and a sponge part and is attached with an agitator, (a) being a view from the front in the axial direction, (b) a first side view, (c) a second side view, (d) a vertical sectional view and (e) a view from the rear in the axial direction.
Figure 13:
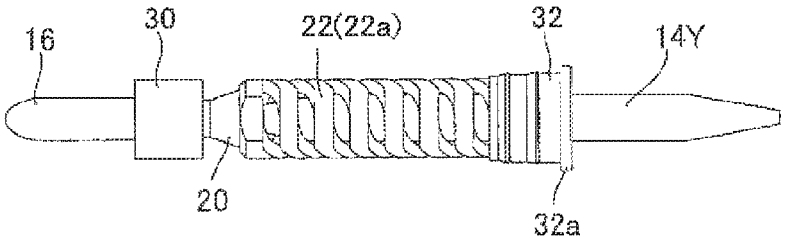
Figure 13:
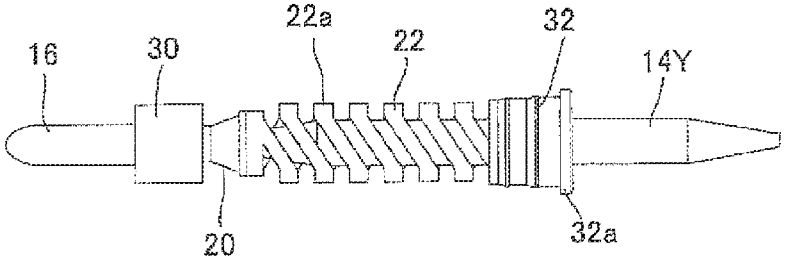
Figure 13:
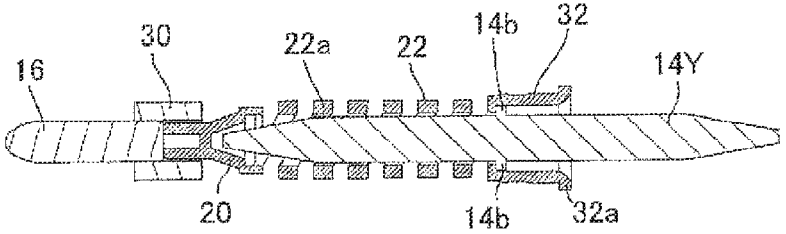
Figure 13:
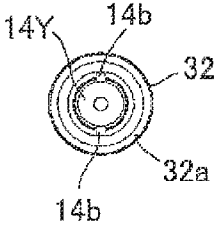
Figure 14:
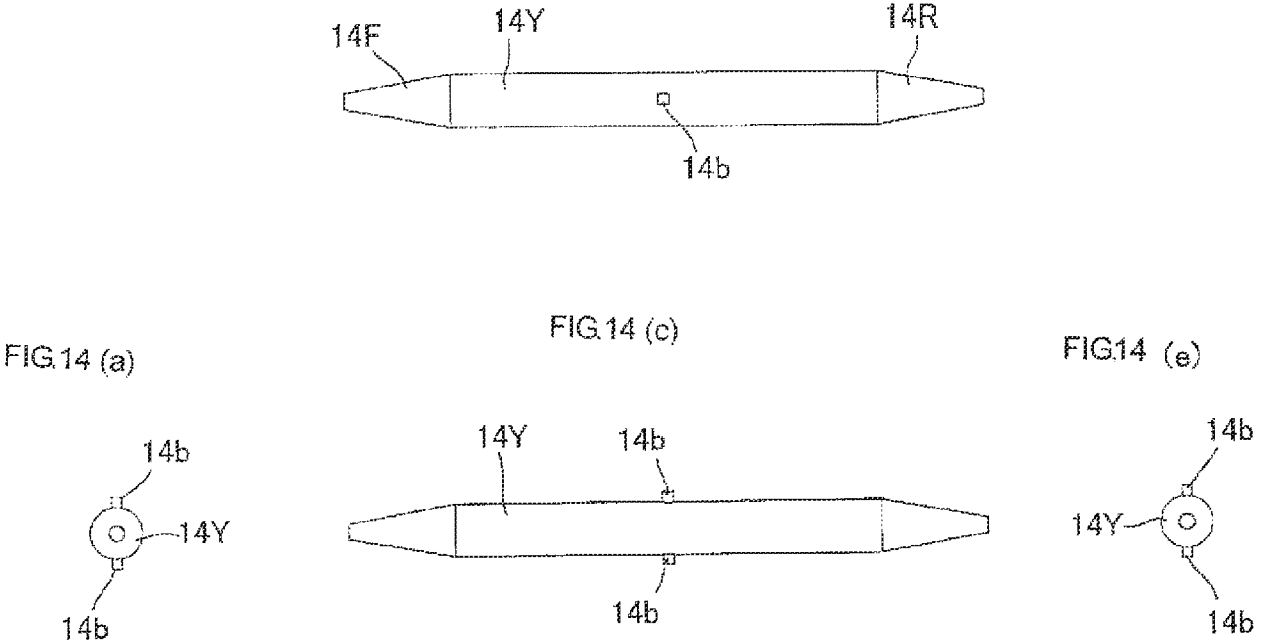
FIG. 14 is an illustrative diagram of an agitator arranged inside the applicator of FIG. 12, (a) being a view from the front in the axial direction, (b) a first side view, (c) a second side view, (d) a vertical sectional view and (e) a view from the rear in the axial direction.
Figure 17:
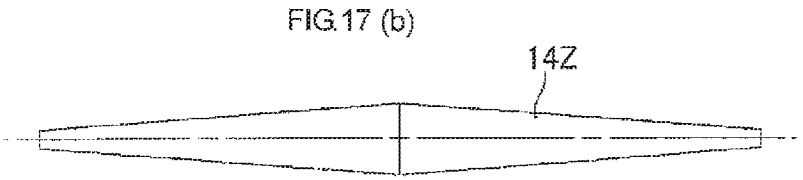
FIG. 17 is an illustrative diagram of an agitator arranged inside the applicator of FIG. 15, (a) being a view from the front in the axial direction, (b) a first side view, (c) a second side view, (d) a vertical sectional view and (e) a view from the rear in the axial direction.
Figure 17:
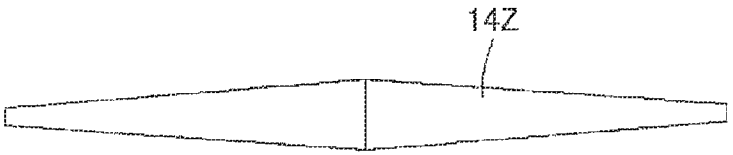
Figure 17:
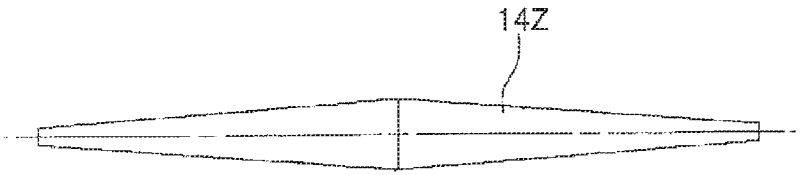
Figure 17:
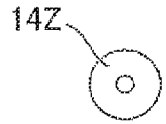
Figure 17:
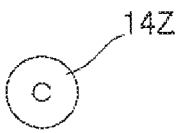
Figure 18:
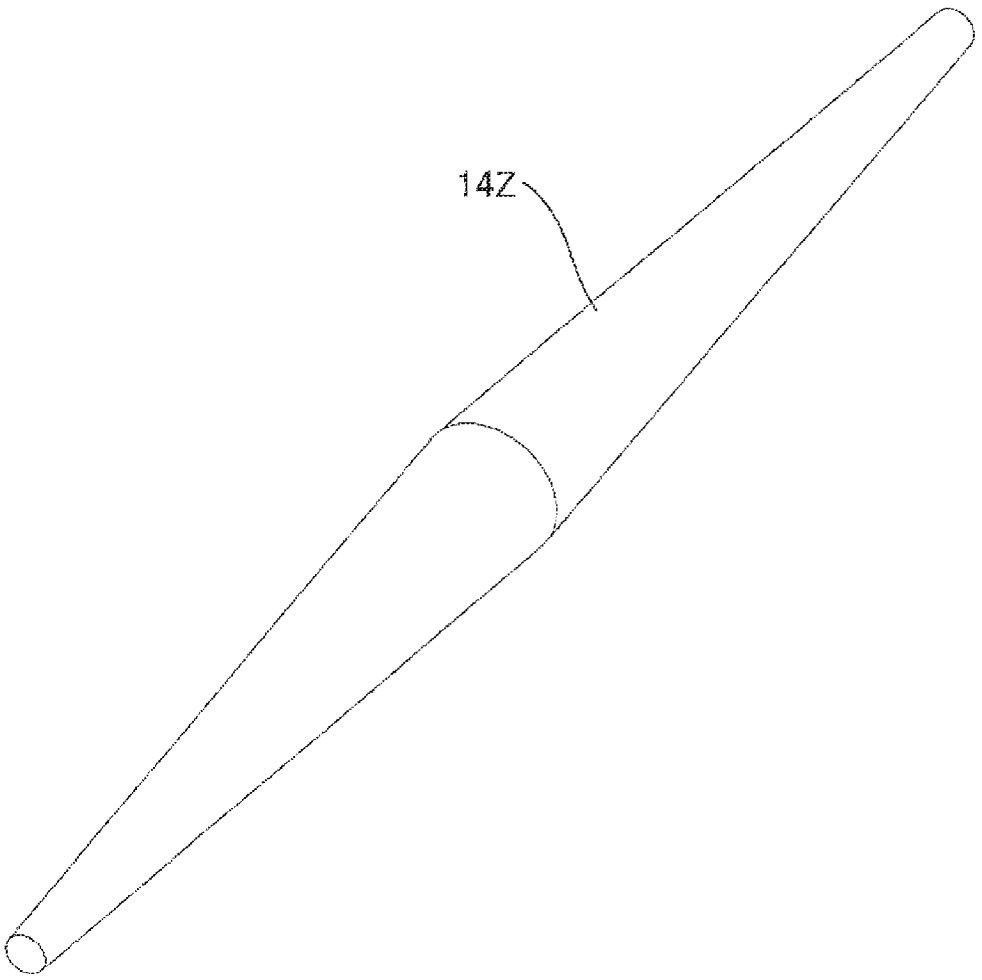
FIG. 18 is a perspective view of an agitator arranged inside the applicator of FIG. 15.
Figure 19:
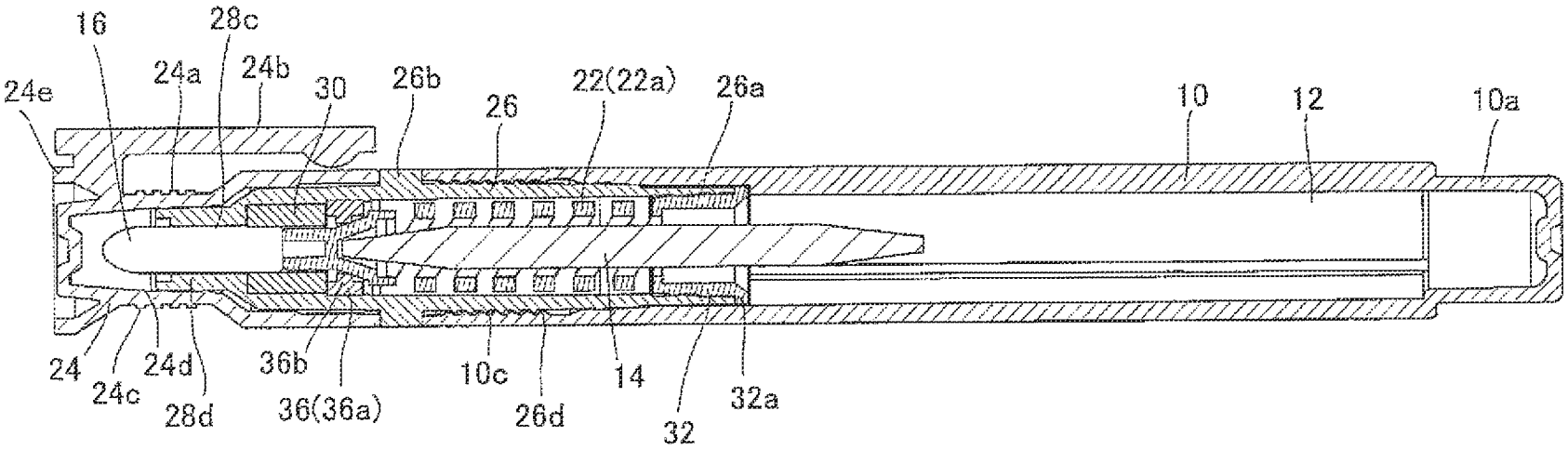
FIG. 19 is an illustrative diagram of an applicator of the sixth embodiment, an overall vertical sectional view.
Figures 20, 20B:
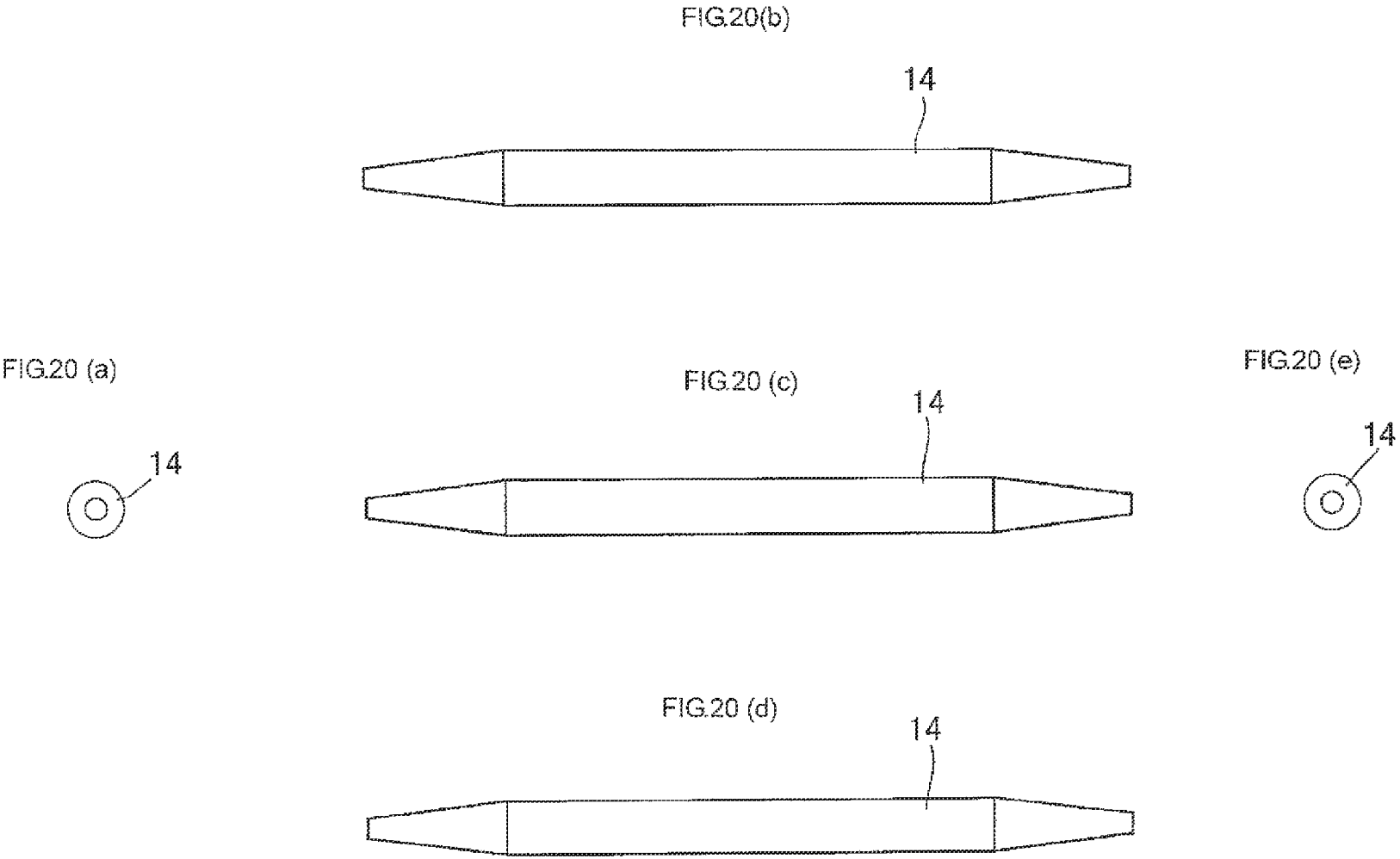
FIG. 20 is an illustrative diagram of an agitator arranged inside the applicator of FIG. 19, (a) being a view from the front in the axial direction, (b) a first side view, (c) a second side view, (d) a vertical sectional view and (e) a view from the rear in the axial direction.

FIGS. 8 to 11 are illustrative diagrams of an applicator and its agitator of the third embodiment; FIGS. 12 to 14 are illustrative diagrams of an applicator and its agitator of the fourth embodiment; FIGS. 15 to 18 are illustrative diagrams of an applicator and its agitator of the fifth embodiment; and FIGS. 19 to 20 are illustrative diagrams of an applicator and its agitator of the sixth embodiment.

As shown in FIGS. 1 and 2, a valved applicator is configured such that an ink tank 12 that is located in the rear part of a barrel cylinder 10 for storing ink is communicated with the interior of the front part of barrel cylinder 10, an agitator 14 is arranged inside the ink tank 12 while an applying part 16 with its front end projected out, a valve element 20 that opens and closes an ink flow path 18 and a spring part 22 that elastically urges the valve element 20 forwards are arranged in the front part of the barrel cylinder 10, and when applying part 16 at the writing point is pressed, the valve element 20 is opened opposing the elastic force of spring part 22 to thereby feed ink to the applying part 16 and enable the applicator to apply ink (write) onto a target object.

The specific configuration of the valved applicator will be explained.

As shown in FIGS. 1 to 2, the rear part of barrel cylinder 10 that is closed at the rear end thereof forms ink tank 12 for storing ink in its interior space while the rear end 10*a* is reduced stepwise in outside diameter so that a cap 24 can be fitted thereon.

Fitted into the front end of the barrel cylinder 10 is an approximately hollow cylindrical front barrel 26. The rear end (fit-in front) 26*a* of front barrel 26 reaches around the middle part of barrel cylinder 10 while a plurality of ribs 12*a* are projectively formed in the axial direction from the rear end to near the middle part on the interior surface of ink tank 12 of barrel cylinder 10.

The aforementioned front barrel 26 has a flange 26*b* on the outer periphery in the middle part. This flange 26*b* abuts the front end 10*b* of barrel cylinder 10 to position the front barrel so that it will not plunge farther into barrel cylinder 10. Further, an annular valve seat 26*c* is projectively and inwardly formed on the inner periphery of front barrel 26 so that the outer periphery of valve element 20 will come into and out of contact with this valve seat 26*c*.

Formed on the outer peripheral part behind flange 26*b* of front barrel 26 is a male thread 26*d*. This male thread 26*d* is mated with and fixed to a corresponding female thread 10*c* on the inner peripheral part of barrel cylinder 10 so that front barrel 26 will not slip out of barrel cylinder 10. A pair of flat cutouts are formed 180° apart from each other on the outer peripheral side of flange 26*b* so that a tool such as a wrench or the like can fit thereon. By holding these cutouts with the tool and turning front barrel 26 relative to barrel cylinder 10, to thereby remove the front barrel from barrel cylinder 10 and refill ink tank 12 with ink. That is, this makes it reusable. It is of course possible to design ink tank 12 as a cartridge type that has a separate structure detachable from barrel cylinder 10.

Fitted into the front end of front barrel 26 is a rear part 28*a* of a plastic mouthpiece 28 as a holder that encloses applying part 16 so that applying part 16 can move back and forth. The front part 28*b* of this plastic mouthpiece 28 is formed on its inner peripheral surface with ribs 28*c* that guides applying part 16 moving back and forth. The front part 28*b* of plastic mouthpiece 28 is formed to be smaller in diameter than rear part 28*a*, correspondingly to applying part 26 while the middle part of the plastic mouthpiece is made greater like a flange in outside diameter so as to abut the front end of front barrel 26 so that rear part 28*a* will not plunge farther into front barrel 26. A sponge 30 is arranged inside rear part 28*a* of plastic mouthpiece 28, enclosing the outer periphery of the rear part of the applying part 16 and valve element 20.

Here, sponge 30 is located in front of valve seat 26*c* of front barrel 26 temporarily stores ink and provides an adjusting function of stably flowing ink to applying part 16, in order to prevent ink from flushing from the ink path toward applying part 16 and flowing out through a gap (between ribs 28*c* of plastic mouthpiece's front part 28*b* and the like) when the contact between valve element 20 and valve seat 26*c* is opened.

Applying part 16 is an approximately rod-like configuration as a whole, tapering with its tip rounded and its rear end cut off.

Figure 6:
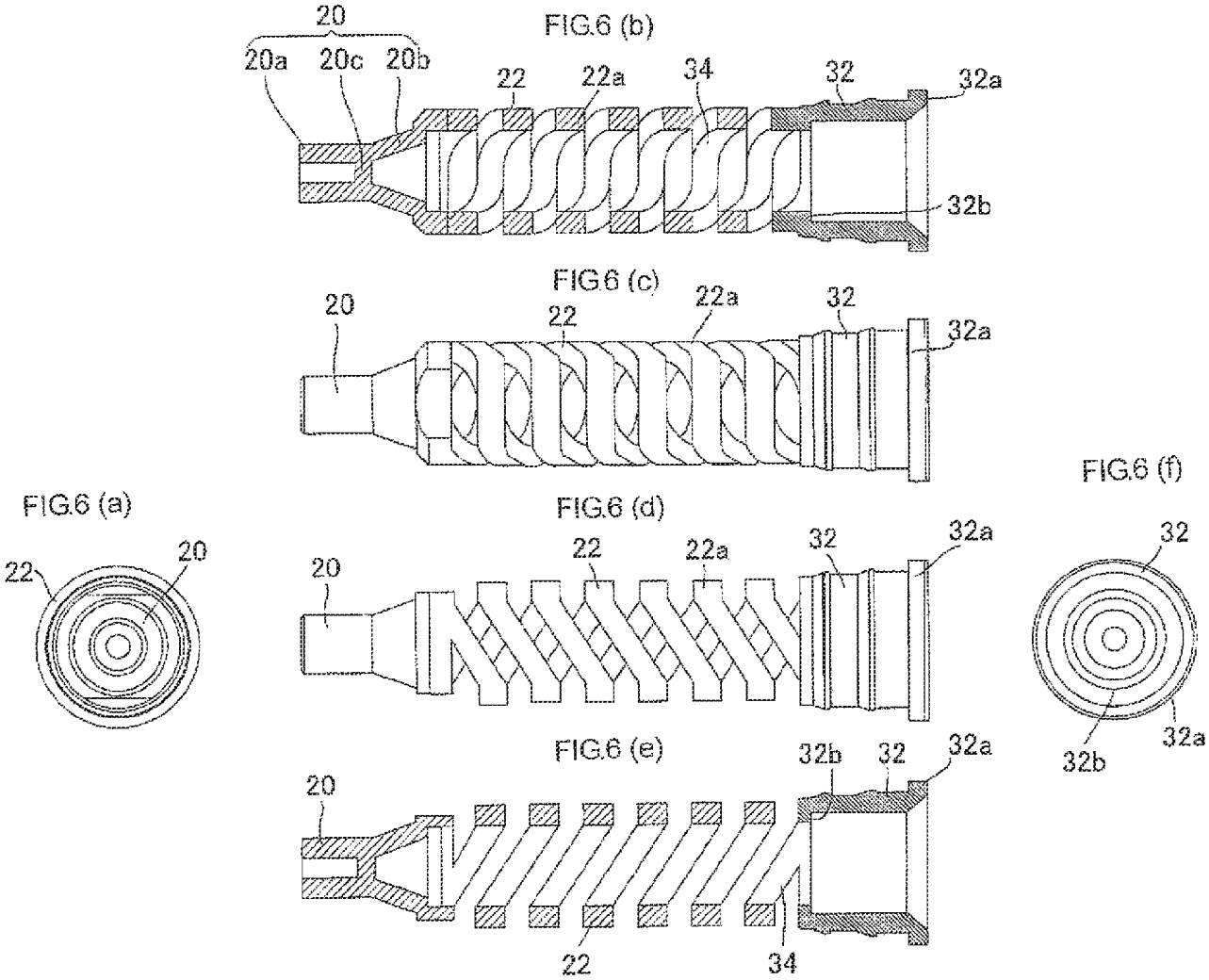
FIG. 6 is an illustrative diagram of a spring part with a valve element integrally formed at the front end thereof, (a) being a view from the front in the axial direction, (b) a vertical sectional view, (c) a first side view, (d) a second side view that is rotated on the axis 90° from the first side view, (e) a vertical sectional view of (d) and (f) a view from the rear in the axial direction.

The aforementioned spring part 22 is formed, as shown in FIGS. 2, 3 and 6, of valve element 20 at the front thereof, an approximately helical elastic portion 22*a* in the middle thereof and a cylindrical part (constraint receiver) 32 having a flange-like portion 32*a* in the rear thereof.

Valve element 20 is formed of a cylindrical front part 20*a*, a rear part 20*b* having a conical side and a partitioning wall 20*c* in the middle.

The conical side of this rear part 20*b* comes into oblique contact with and out of the inner surface of the circular opening of valve seat 26*c* of front barrel 26 so as to open and close ink flow path 18.

Formed inside the spring part 22 is a space 34 which the agitator 14 can be inserted into and taken out of. That is, that spring part defines hollow space 34 that extends from cylindrical part 32 at the rear through elastic portion 22*a* to the rear part 20*b* of valve element 20 at the front, in the center in section, so that agitator 14 can be inserted into and pulled out of this space 34.

Here, the aforementioned agitator 14 is given in a rod-like form with its rear end part 14*a* made greater in diameter than the other part and formed in a flange shape with a partial cutout.

Spring part 22 has cylindrical part (constraint receiver) 32 as its rear end part that is integrally formed of resin, the cylindrical part having an inner step 32*b* forming an abutment having an inside diameter that is smaller than the outside diameter of the rear end part 14*a* of the agitator 14. This cylindrical part 32 engages the rear end part 14*a* of the agitator 14 with its inner step 32*b* so as to restrain the front end of the agitator 14 from abutting the inner surface (partition 20*c*) of valve element 20 at the front end of spring part 22.

Cylindrical part 32 at the rear end of the spring element 22 has projected and indented outer peripheral surface, which engages the projected and indented inner peripheral surface in the rear end of front barrel 26 so that spring part 22 will not come off from front barrel 26. The rear end of cylindrical part 32 extends outwards in diameter, forming flange portion 32*a* so that rear end 26*a* of front barrel 26 abuts flange-like portion 32*a* when front barrel 26 is attached, so as to prevent spring element from plunging down further. Further, when front barrel 26 with this spring part 22 having been fitted therein is inserted and screw-fixed to front end 10*b* in barrel cylinder 10, the flange-like portion 32*a* is positioned by ribs 12*a* on the inner peripheral surface of ink tank 12. That is, this flange-like portion 32*a* is held between front barrel 26 on the front side and ribs 12*a* on the rear side so that rear end part is fixed in position inside barrel cylinder 10 while valve element 20 arranged at the front end can move forwards and backwards.

Elastic portion 22*a* of the spring part 22 is formed by shaping two lines in an approximately helical configuration, along four surfaces each having an approximately rectangular shape when viewed in cross section, as shown in FIG. 3. The lines on one pair of two opposing surfaces are arranged approximately perpendicular to the axial direction while the lines are arranged obliquely with respect to the axial direction, on the other pair of two opposing surfaces.

Spring part 22 has the aforementioned valve element 20 as its front end that is integrally formed of resin.

Referring to FIGS. 1, 2, 4 and 5, cap 24 will be explained.

Cap 24 is externally fixed on front barrel 26 in a detachable manner so as to cover from front barrel 26, holder 28 and applying part 16 in the front part of the applicator.

Cap 24 has a holding portion 24*a* that is narrowed in the center with respect to the axial direction, having an outside diameter reduced compared to that of the front part and that of the rear part in the axial direction so as to allow the fingers to pick it up.

In this way, annular holding portion 24*a* is formed so that the user is ready to take out from barrel cylinder 10 by holding it with the fingertips. Further, since provision of holding portion 24*a* makes it possible to positively apply a holding force on the cap by picking narrowed holding portion 24*a* when the user of the applicator tries to take out cap 24 in their gloved fingers, cap 24 can be put on and taken off without slipping, hence making it possible to readily use especially on a worksite and/or construction site.

Further, the narrowed holding portion 24*a* is more readily to hold compare to the simple jaggedness in the prior art, hence the cap will not be slipped off. Further narrowed holding portion 24*a* may be bound with a cord so as to make it easy to carry.

Further, since cap 24 is narrowed around holding portion 24*a*, the portion that seals the outer periphery of holder 28 and the like supporting applying part 16 in the front end of barrel cylinder 10 can also be narrowed so that thinning of cap 24 can be easily realized.

Cap 24 has an approximately bowl-like configuration, closed at the front end and annularly indented in the middle thereof in the axial direction and having a rear end that abuts flange 26*b* of front barrel 26. Here, a clip 24*b* is provided on the outer side of cap 24 so that the applicator can be fixed by clip 24*b* nipping a user's pocket.

Further, a slip stopper 24*c* is formed on the outer side of cap 24.

The aforementioned slip stopper 24*c* is formed of multiple flange-like projections and indentations arranged in parallel in the circumferential direction around the bottom of holding portion 24*a*.

The tips of the projections in the jagged configuration of slip stopper 24*c* are formed with acute angles (equal to or less than 90°) having a rectangular configuration when viewed in section. Formation of the tips of the projections with acute angles enables even gloved fingertips to easily hold, hence making it possible to take off the cap easily with weak force. The acute angles may be given in various forms such as a triangular configuration, serrated configuration and the like when the projections of the jagged configuration are viewed in section. In example 1, as shown in FIGS. 5(*a*) to (*c*), the jagged configuration of slip stopper 24*c* on the outer peripheral side in the bottom of holding portion 24*a* is formed with annular ribs having a cross-section of an acute-angled triangle (equal to or less than 90°) with its distal end pointed radially outwards. In example, 2, as shown in FIGS. 5(*d*) to (*f*), the jagged configuration of slip stopper 24*c* on the outer peripheral side in the bottom of holding portion 24*a* is formed with annular ribs having a cross-section of an acute-angled triangle (equal to or less than 45°) with its distal end pointed radially outwards and rearwards. In example 2, the slip stopper has a configuration of umbrellas opening rearwards.

It is preferable that the surface of barrel cylinder 10 is also formed with slip stopper shaping such as a jagged configuration or the like. The shaping for slip stopper may be formed by provision of an elastic material such as rubber etc., other than the above-described jagged configuration.

Clip 24*b* arranged over the outer peripheral side of cap 24 is formed to be narrower than the outside diameter of the holding portion 24*a*. Provision of clip 24*b* having a smaller width than the outside diameter of the holding portion 24*a* permits the user to hold holding portion 24*a* without any interference while providing the essential function of clip 24*b*. Here, the thickness of cap 24 is preferably specified such that cap top diameter>holding portion 24*a*>clip 24*b* width.

Here, as shown in FIGS. 2(*a*) and (*b*), holder 28 for holding the applying part is arranged in the front end of the barrel cylinder and formed so that the front side of holder 28 is smaller in diameter than the rear side.

As the structure of fixing cap 24 to the applicator in a removable manner, cap 24 can be fitted to front barrel 26 (the first fitting structure) or cap 24 may be fitted to both front barrel 26 and holder 28 (the second fitting structure) (in FIG. 4(*h*) fitting ribs 24*h* on the inner peripheral side of cap 24 are shown).

In the first fitting structure, the inner peripheral surface of cap 24 is made to fit on the outer peripheral surface of the front part of flange 26*b* of front barrel 26. Fitting ribs 26*h* and 24*h* are annularly formed correspondingly on the outer peripheral surface of front barrel 26 and the inner peripheral surface of cap 24, respectively, so that ribs 26*h* and 24*h* mate each other, providing anti-falling and sealing functions, as cap 24 is fitted.

On the other hand, when the second fitting structure is adopted, ribs 26*h* on the outer periphery of the aforementioned front barrel 26 and ribs 24*h* on the inner periphery of cap 24 are made to fit each other, and sealing structures 24*d* and 28*d* for keeping the surrounding space of the applying part airtight are formed at associated positions on the outer periphery of the small-diametric part of holder 28 and the inner periphery of cap 24.

In the second fitting structure, sealing structure 24*d* of the inner periphery of cap 24 is formed on the inner side of the holding portion 24*a*. In this way, sealing structures 24*d* and 28*d* are formed in the small-diametric fitting positions, hence it is possible to enhance sealing performance by shortening the sealing length, compared to the large-diametric case.

As shown in FIG. 4(*e*), plural projections designated by a reference numeral 24*f* are projections on the inner periphery of cap 24, providing functions of supporting the outer periphery of the small-diametric holder 28 to keep it center and reliably fitting sealing structures 24*d* and 28*d* to each other to keep airtightness. A reference numeral 24*g* designates fitting ribs that extend in the axial direction on the inner peripheral and enable the cap 24 fitted to the small-diametric part of rear end 10*a* of barrel cylinder 10 even when cap 24 is unused.

The inner periphery of the holding portion 24*a* and its front side of cap 24 is so formed that the inside diameter is smaller around applying part 16 than around holder 28 with its front end closed while an outer peripheral part 24*e* in front of the holding portion 24*a* is made greater toward the front, forming a hollowed bowl-like shape. With this configuration, the outer peripheral part 24*e* in front of holding portion 24, given in the bowl-like shape on the outer side is formed to be thin so that cap 24 will not produce sinks at the time of resin molding. Thus, this outer peripheral part 24*e* is integrally formed in junction with cap 24.

Also, each component of the applicator according to the present invention is preferably formed of resin materials. In the first embodiment, applying part 16 is formed of a bundle of fibers, continuous-foamed body, molding or the like of polyethylene terephthalate (PET). The barrel cylinder 10, front barrel 26, holder 28 and cap 24 are formed of polypropylene (PP). Spring part 22 and agitator 14 are formed of polyacetal (POM) while sponge 30 is formed of urethane. Further, each part is formed by injection molding. Since barrel cylinder 10 and front barrel 26 are formed with high precision by injection molding, the opposing screw-joint parts can be made with high precision while rear end 10*a* is formed with little burrs so that the external appearance can be improved.

The operation of the applicator according to the first embodiment will be described.

During storage of the applicator, the applying part 16 is placed downwards or the like while valve element 20 at the front end of spring part 22 is pressed forwards by the elastic force of elastic portion 22*a* and put into hermetic contact with valve seat 26*c* of front barrel 26 so that ink flow path 18 is closed (in the state shown in FIG. 2).

On the other hand, ink is agitated at the time of using. As the applicator is shaken, agitator 14 moves back and forth inside ink tank 12 to thereby agitate ink. During this, since the agitator 14 has flange-like rear end part 14*a* that is enlarged in diameter, the flange is caught by inner step 32*b* of cylindrical part 32 at the rear end of front barrel 26 as shown in FIG. 2, so that the agitator will not move farther towards valve element 20. Accordingly, there is no risk of valve element 20 being opened by any impact.

Then, the user presses applying part 16 onto the desk or the like so as to move applying part 16 backwards, opposing the elastic force of spring part 22. As a result, valve element 20 at the front end of spring part 22 in the rear of the applying part 16 is released from valve seat 26*c* of front barrel 26 so that ink flow path 18 is opened, whereby ink is supplied through sponge 30 to applying part 16. Here, since rear end part 14*a* of agitator 14 is a flange-like part with its part cut out, ink flow path 18 into space 34 can be assured by the cutout of the rear end part 14*a* even if agitator 14 goes into space 34 of spring part 22, so that ink can flow without a break, hence whereby it possible to smoothly apply ink or write.

According to the valved applicator according to the above embodiment, agitator 14 is given in a rod-like form having a greater diameter in the rear end part than the other part, and space 34 which the agitator 14 can be inserted into and pulled out from is formed inside the spring part 22 while in barrel cylinder 10, a constraint receiver to restrain the front end of the agitator 14 from abutting the interior in the front end portion of spring part 22 by making inner step 32*b* of cylindrical part 32 catch the rear end part of the agitator 14 is provided.

Accordingly, when the applicator is shaken to agitate by means of the agitator 14, the agitator 14 will not collide with the inner side of the front end of spring part 22, so that valve element 20 will not open, hence will not cause any ink leakage and ink flood.

Further, since valve element 20 that is integrally formed of resin is formed at the front end of spring part 22, it is possible to reduce the number of parts and simplify molding and handling.

Moreover, when the cylindrical part (constraint receiver) having inner step 32*b* as an abutment having an inside diameter smaller than the outside diameter at the rear end part of the agitator 14 is formed of resin integrally with spring part 22 at its rear end part, there is no need of separate attachment, and hence molding and handling can be further simplified.

Further, since agitator 14 is made of resin and can be formed by injection molding, this produces good productivity and other effects.

The applicator according to the present invention is not limited to the first embodiment, and various kinds of variations can be realized. For example, the valved applicator of the present invention may be formed as in the second embodiment shown in FIG. 7. In this valved applicator of FIG. 7, the same reference numerals are allotted to the same components as those in the applicator of the first embodiment.

Though, in the second embodiment as shown in FIG. 7, plastic mouth piece 28 is fitted at the front end of front barrel 26 and valve seat 26*c* is integrally formed with the front barrel, a plastic mouthpiece is integrally formed with the front end part of front barrel 26 while the valve seat is configured so that a valve receiving part 36 is separated from the front barrel so that the valve seat is fitted into the front barrel 26.

This valve receiving part 36 is formed of an approximately annular outer peripheral body 36*a* and an abutment 36*b* that projects inwards like a flange from the inner peripheral surface. Rear part 20*b* of valve element 20 comes into oblique contact with and out of the abutment so as to open and close the valve.

Since this valved applicator according to the second embodiment is constructed so that front barrel 26 and valve receiving part 36 are formed separately, the material of valve receiving part 36 can be selected freely, hence this configuration is advantageous in obtaining the hermitic performance for the valve.

It is noted that the valved applicator of the present invention can be configured without ribs inside the ink tank and without a clip for the cap.

In the applicator of the present invention, various kinds of agitators can be realized.

In the applicators of the third embodiment to the fifth embodiment, agitators 14 (agitators 14X to 14Z) which are symmetrical (symmetrical between front and rear halves) with respect to the front-to-rear direction (longitudinal direction) will be described.

In the third embodiment to the fifth embodiment, since the symmetric configuration of agitators 14 (agitators 14X to 14Z) with respect to the front-to-rear direction makes it unnecessary to care about the direction of insertion into barrel cylinder 10, these are more excellent in assembly performance compared to the agitators that are unsymmetrical with respect to the front-to-rear direction as in the first and second embodiments.

Figure 8:
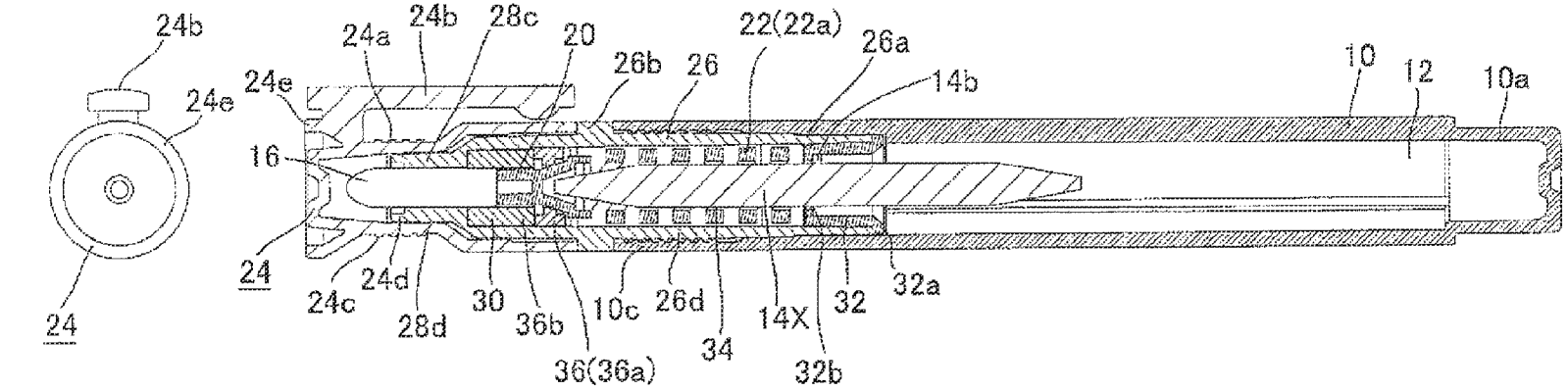
FIG. 8 is an illustrative diagram of the applicator of the third embodiment, (a) being a view from the front in the axial direction and (b) a vertical sectional view.
Figure 9:
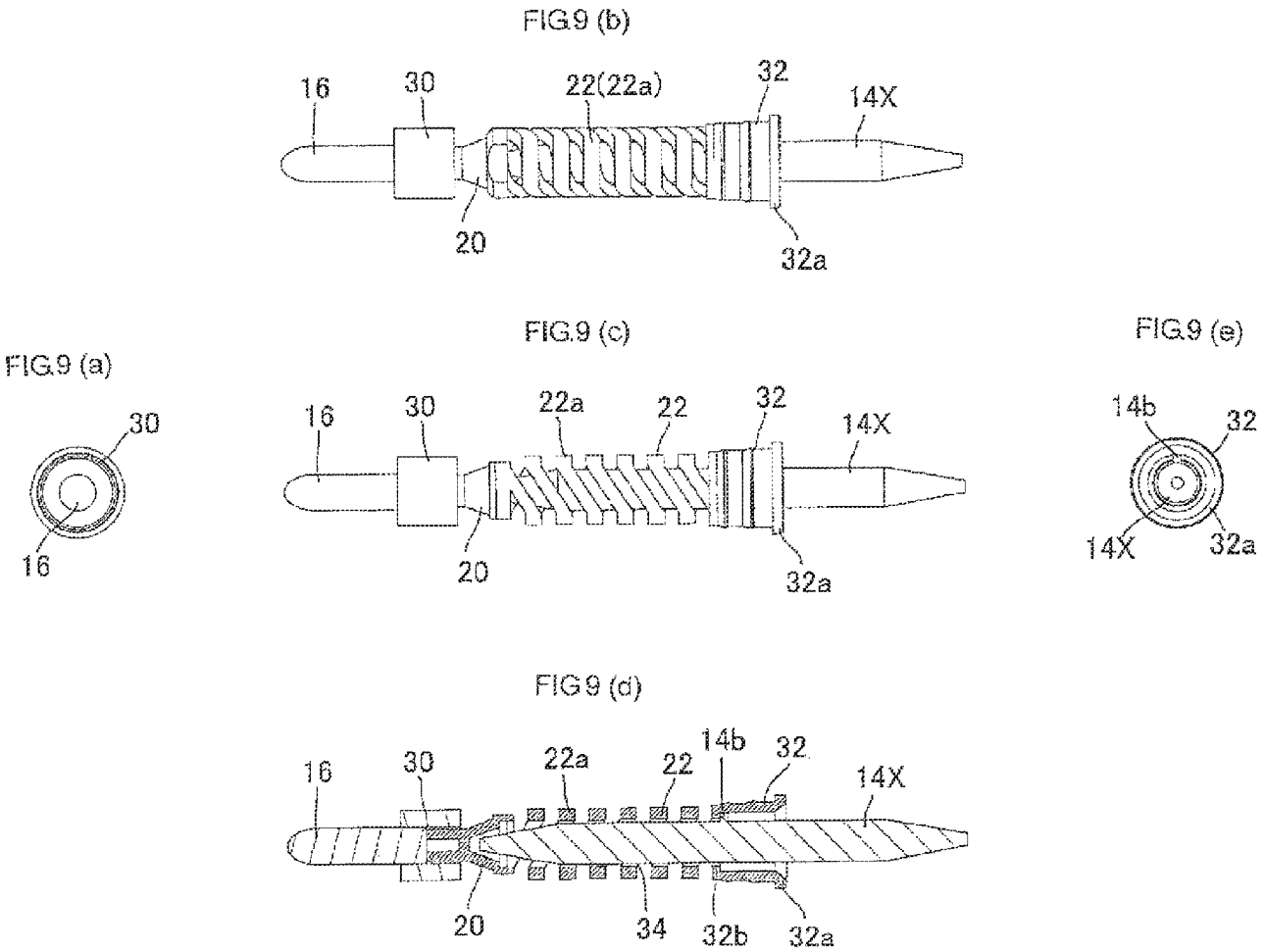
FIG. 9 is an illustrative diagram of an applicator of FIG. 8 in which a spring part with a valve element integrally formed at the front end thereof is assembled with an applying part and a sponge part and is attached with an agitator, (a) being a view from the front in the axial direction, (b) a first side view, (c) a second side view, (d) a vertical sectional view and (e) a view from the rear in the axial direction.

FIGS. 8(*a*) to (*b*) are overall illustrative diagrams of an applicator according to the third embodiment; FIGS. 9(*a*) to (*e*) are illustrative diagrams of the applicator, in which a spring part with a valve element integrally formed at the front end thereof is assembled with an applying part and a sponge part and is attached with an agitator; FIGS. 10(*a*) to (*e*) are illustrative diagrams of an agitator arranged inside the applicator; and FIG. 11 is a perspective view of an agitator arranged inside the applicator.

As shown in FIG. 8, the applicator according to the third embodiment has the same configuration as the applicator according to the second embodiment shown in FIG. 7, except in that the configuration of an agitator 14X is significantly different, ribs are formed inside ink tank 12 and clip 24*b* is provided for cap 24. The same components are allotted with the same reference numerals.

As shown in FIGS. 8 to 11, agitator 14X provided for the applicator according to the third embodiment is given in an approximately rod-like form with a front end part (14F) and rear end part (14R) in the front-to-rear direction, tapered in the same manner, forming tapering ends. The agitator 14X is symmetrical with respect to the front-to-rear direction and has a single projection 14*b* projected radially outwards at the middle point in the front-to-rear direction.

This agitator 14X may be handled without caring about the direction of insertion into the barrel cylinder, hence being excellent in assembly performance.

Further, the front part of agitator 14X goes into space 34 that opens rearwards in spring part 22, in an insertable and removable manner, from the hollow of cylindrical part 32. In this condition, projection 14*b* abuts inner step 32*b* of cylindrical part 32 so that the agitator will not enter farther.

Further, the inner periphery of flange-like portion 32*a* of cylindrical part 32 is cut so as to open wider towards the rear, so that agitator 14X is liable to enter cylindrical part 32. Moreover, agitator 14 is arranged so that the rear part is projected into ink tank 12 when the front part is inserted into space 34 of spring part 22.

FIGS. 12(*a*) to (*b*) are illustrative diagrams of an applicator according to the fourth embodiment; FIGS. 13(*a*) to (*e*) are illustrative diagrams of the applicator, in which a spring part with a valve element integrally formed at the front end thereof is assembled with an applying part, a sponge part and an agitator; and FIGS. 14(*a*) to (*e*) are illustrative diagrams of an agitator arranged inside the applicator. Since the configuration other than agitator 14 is the same as the applicator according to the third embodiment, the same components are allotted with the same reference numerals.

As shown in FIGS. 12 to 14, the applicator according to the fourth embodiment is formed so that its agitator 14Y is formed with a pair of projections 14*b* and 14*b*, on the outer periphery thereof at the middle point in the front-to-rear direction, projected radially outwards, axially symmetrically. Agitator 14Y is given in an approximately rod-like form with a front end part (14F) and rear end part (14R) in the front-to-rear direction, tapered in the same manner, forming tapering ends.

Also in this case, owing to the symmetrical configuration of agitator 14Y with respect to the front-to-rear direction, the agitator may be handled without caring about the direction of insertion into the barrel cylinder, hence being excellent in assembly performance. Further, since paired projections 14*b* and 14*b* are projectively formed axially symmetrically and radially outwards to opposite sides, the agitator can abut inner step 32*b* of the cylindrical part 32 in a well-balanced manner, so that agitator 14Y is unlikely to jolt (unlikely to shake left and right) inside space 34 of spring part 22, hence producing little rattle and vibration.

Figure 15:
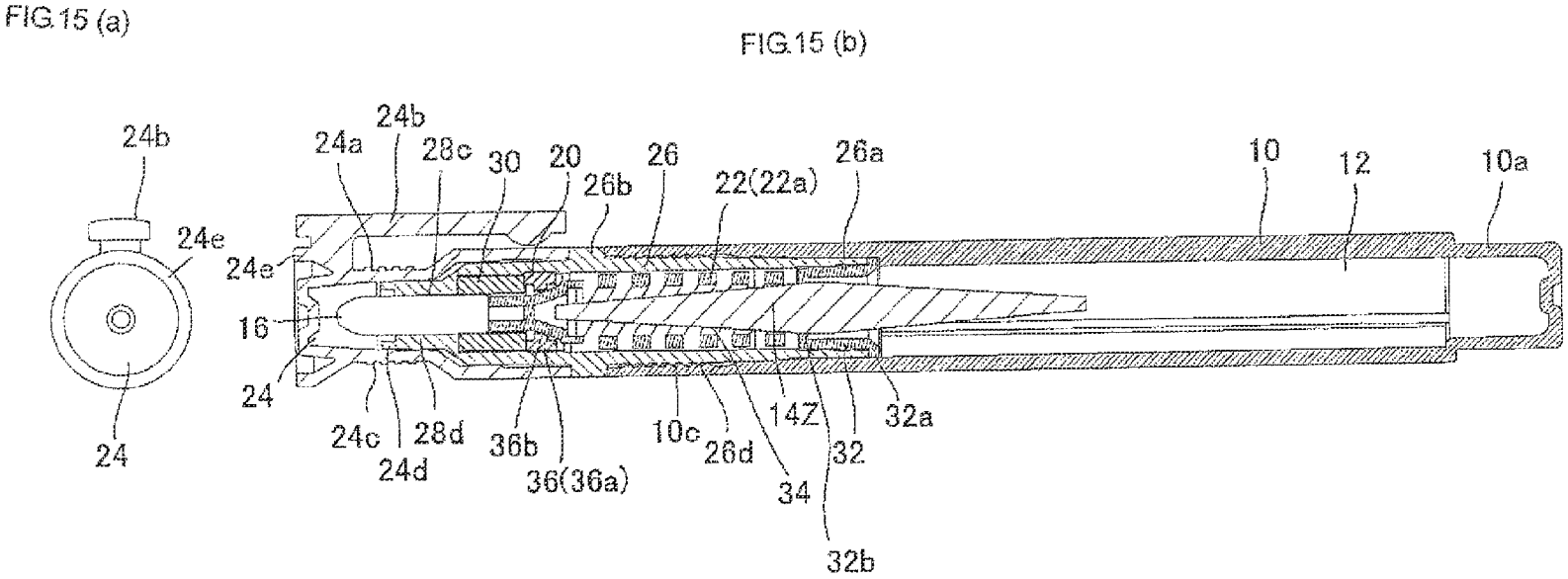
FIG. 15 is an illustrative diagram of an applicator of the fifth embodiment, (a) being a view from the front in the axial direction and (b) a vertical sectional view.
Figure 16:
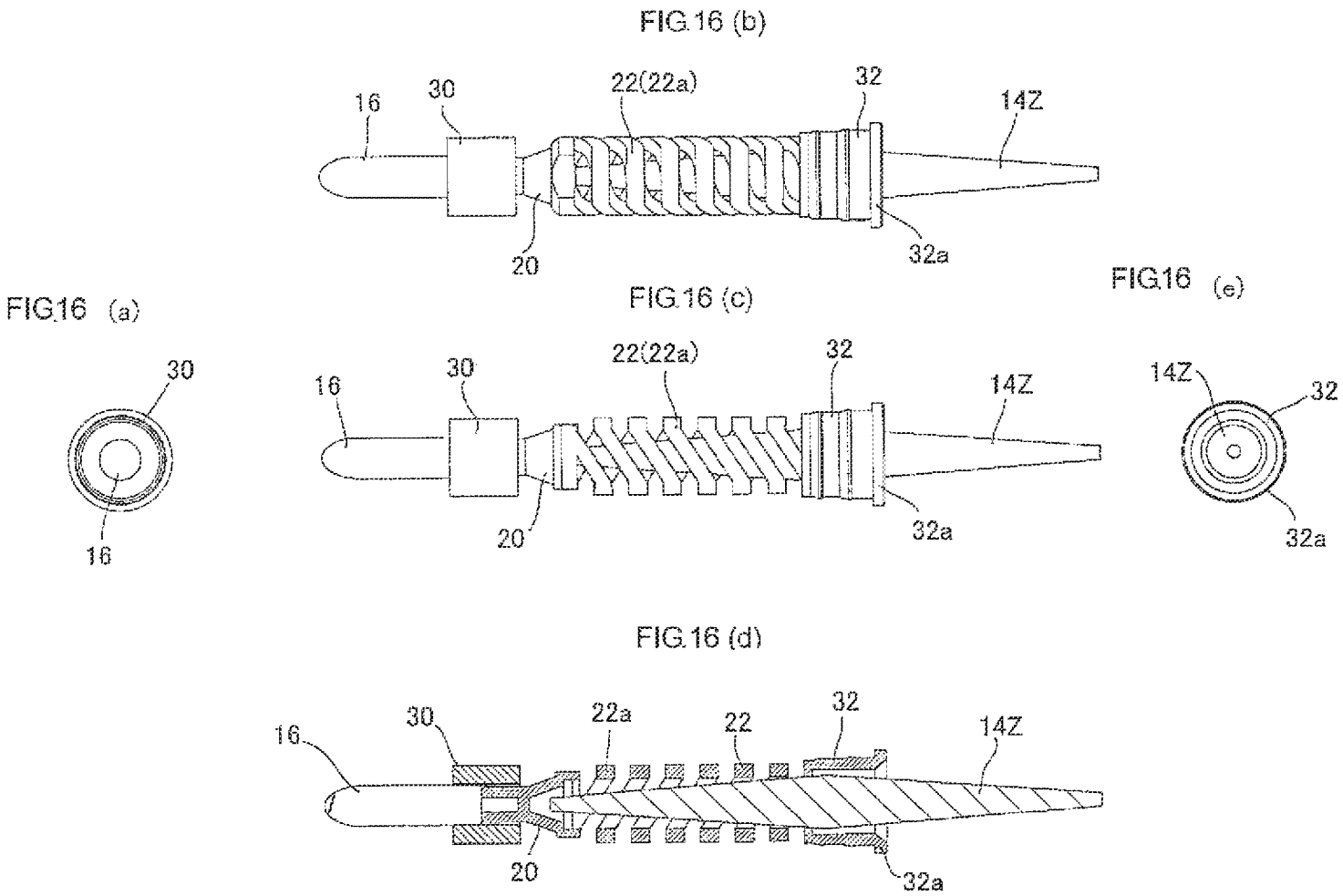
FIG. 16 is an illustrative diagram of the applicator of FIG. 15 in which a spring part with a valve element integrally formed at the front end thereof is assembled with an applying part, a sponge part and an agitator, (a) being a view from the front in the axial direction, (b) a first side view, (c) a second side view, (d) a vertical sectional view and (e) a view from the rear in the axial direction.

FIGS. 15(*a*) to (*b*) are illustrative diagrams of an applicator according to the fifth embodiment; FIGS. 16(*a*) to (*e*) are illustrative diagrams of the applicator, in which a spring part with a valve element integrally formed at the front end thereof is assembled with an applying part and a sponge part and is attached with an agitator; FIG. 17 is an illustrative diagram of the agitator arranged inside the applicator; and FIG. 18 is a perspective view of an agitator arranged inside the applicator.

As shown in FIGS. 15 to 18, the applicator according to the fifth embodiment is formed so that its agitator 14Z has the maximum outside diameter at the middle point in the front-to-rear direction and is tapered towards both the front and rear ends from that middle point. Agitator 14Z is formed so that the outside diameter at that middle point is greater than the inside diameter of inner step 32*b* of cylindrical part 32.

Accordingly, also in this case, owing to the symmetrical configuration of agitator 14Z with respect to the front-to-rear direction, the agitator may be handled without caring about the direction of insertion into the barrel cylinder, hence being excellent in assembly performance. Further, since agitator 14Z has the maximum outside diameter at the middle point and is tapered as described above, the agitator is stopped and will not enter space 34 of spring part 22 farther when the middle point of agitator 14Z abuts inner step 32*b* of cylindrical part 32. In this case, in the stopped position the rear end of agitator 14Z faces ink tank 12.

Further, when agitator 14Z goes into the space 34, the agitator smoothly enters and smoothly stops. Moreover, since agitator 14Z is not formed with any projections, the agitator can be readily formed because it is not necessary to provide projections to mold agitator 14Z.

FIGS. 19(*a*) to (*b*) are illustrative diagrams of an applicator of the sixth embodiment and FIG. 20 is a perspective diagram of an agitator 14 arranged inside the applicator.

As shown in FIGS. 19 to 20, the applicator according to the sixth embodiment is constructed so that an agitator 14 is given in an approximately rod-like form with its front end part and rear end part in the front-to-rear direction, tapered in the same manner, forming tapering ends. Accordingly, also in this case, owing to the symmetrical configuration of agitator 14 with respect to the front-to-rear direction, the agitator may be handled without caring about the direction of insertion into the barrel cylinder, hence being excellent in assembly performance. Moreover, since agitator 14 is not formed with any projections, the agitator can be readily formed because it is not necessary to provide projections to the mold of agitator 14.

INDUSTRIAL APPLICABILITY

The valved applicator of the present invention can be applied to applicators for applying chemicals, cosmetics and other application fluids to a target object as well as to various kinds of writing implements for writing on a target object.

DESCRIPTION OF REFERENCE NUMERALS

10 barrel cylinder
10*a* rear end
10*b* front end
10*c* female thread
12 ink tank
12*a* rib
14 agitator (the first and second embodiments)
14*a* rear end part
14F, 14R front end part, rear end part (the third and fourth embodiments)
14X, 14Y, 14Z, 14 agitator (the third, fourth, fifth and sixth embodiments)
16 applying part
18 ink flow path
20 valve element
20*a* front part
20*b* rear part
20*c* partitioning wall
22 spring part
22*a* spring part's elastic portion
24 cap
24*a* holding portion
24*b* clip
24*c* slip stopper
24*d* sealing structure
24*e* outer peripheral part
24*f* projection
24*g* fitting rib
24*h* rib
26 front barrel
26*a* front barrel's rear end
26*b* front barrel's flange
26*c* front barrel's valve seat
26*d* front barrel's male thread
28 plastic mouthpiece (holder)
28*a* plastic mouthpiece's rear part
28*b* plastic mouthpiece's front part
28*c* plastic mouthpiece's rib
28*d* plastic mouth piece's sealing structure
30 sponge
32 cylindrical part
32*a* flange-like portion
32*b* inner step
34 space
36 valve receiving part (the second embodiment)
36*a* outer peripheral body
36*b* abutment

The invention claimed is:

1. An applicator cap closed on a front side and opening on a rear side, covering an applying part provided in a front end of a barrel cylinder of an applicator, the applying part being inserted from the opening on the rear side and into the applicator cap, and detachably fitted on the barrel cylinder so as to be able to seal and keep a surrounding space of the applying part airtight, wherein an outer periphery of the cap has an annular indentation configuration formed in such a manner that an outside diameter of a middle part of the cap with respect to an axial direction of the cap is smaller than an outside diameter of a front end of the cap with respect to the axial direction and an outer periphery of the front end and an outer periphery of the middle part are continuously formed by way of a step having an angle, a slip stopper is formed, on an outer peripheral surface in a bottom of the middle part of the cap with respect to the axial direction, in a projected and indented configuration, a distal part of a projected portion in the projected and indented configuration is acute-angled, and the projected portion is annularly formed, a clip having a narrower width than the outside diameter of the middle part of the cap with respect to the axial direction is provided on an outer peripheral side of the cap, the barrel cylinder is provided at a front end of the barrel cylinder with a holder for holding the applying part, a diameter on a front side of the holder is smaller than a diameter on a rear side of the holder, and a sealing structure for keeping the surrounding space of the applying part airtight is formed at a corresponding position between an outer periphery of the smaller diameter part of the holder and an inner periphery of the cap, the sealing structure of the inner periphery of the cap is formed on an inner peripheral side of the middle part of the cap with respect to the axial direction, and the inner periphery of the cap is so formed that an inside diameter around the applying part is smaller than an inside diameter around the holder and a front end of the inner periphery of the cap is closed while an outer peripheral part in front of the middle part with respect to the axial direction is made greater toward the front, forming a hollowed bowl-like shape.

2. The applicator cap according to claim 1, wherein the middle part of the cap with respect to the axial direction is narrowed or smaller in outside diameter than the front end and the rear end with respect to the axial direction, forming a holding portion that is formed in a shape that can be held by fingertips.

3. The cap according to claim 1, wherein the distal part of the projected portion is formed with angles equal to or less than 90°.

4. The cap according to claim 1, wherein the distal part of the projected portion is formed such as a triangular configuration when the distal part is viewed in section.

5. The cap according to claim 1, wherein the distal part of the projected portion is formed such as a serrated configuration when the distal part is viewed in section.

* * * * *